US008307664B2

(12) United States Patent
Whillock, Sr.

(10) Patent No.: US 8,307,664 B2
(45) Date of Patent: Nov. 13, 2012

(54) PORTABLE COOLER WITH INTERNAL ICE MAKER

(76) Inventor: Donald Whillock, Sr., Marianna, FL (US)

( * ) Notice: Subject to any disclaimer, the term of this patent is extended or adjusted under 35 U.S.C. 154(b) by 410 days.

(21) Appl. No.: 12/798,704

(22) Filed: Apr. 9, 2010

(65) Prior Publication Data

US 2010/0251730 A1 Oct. 7, 2010

Related U.S. Application Data

(63) Continuation of application No. 11/888,276, filed on Jul. 31, 2007, now abandoned.

(51) Int. Cl.
*F25B 21/02* (2006.01)

(52) U.S. Cl. ..... 62/3.63; 62/457.5

(58) Field of Classification Search ..... 62/3.6, 62/3.63, 3.2, 3.3, 3.62, 340, 344, 347, 457.1, 62/457.5, 457.9; 220/592.02, 592.03
See application file for complete search history.

(56) References Cited

U.S. PATENT DOCUMENTS 3,131,551 A * 5/1964 Ross ..... 62/298
3,146,601 A * 9/1964 Gould ..... 62/3.6
3,163,019 A * 12/1964 Hall ..... 62/137
3,357,200 A 12/1967 Connors
D217,074 S * 3/1970 Jones et al. ..... D15/83
3,665,728 A 5/1972 Stoller
3,796,063 A 3/1974 Wulke et al.
3,803,862 A * 4/1974 Schumacher ..... 62/137
3,908,391 A 9/1975 Wulke et al.
D256,587 S * 8/1980 Tatsumi ..... D15/83
D267,324 S * 12/1982 Norimatsu et al. ..... D15/83
4,474,023 A * 10/1984 Mullins, Jr. ..... 62/137
D292,711 S * 11/1987 Shapiro et al. ..... D15/83
4,897,099 A * 1/1990 Ruff ..... 62/532
D314,579 S * 2/1991 Maxwell et al. ..... D15/80
D320,606 S * 10/1991 Fritsch ..... D15/83
D329,172 S * 9/1992 Greene, Jr. ..... D7/605
D335,960 S * 6/1993 Kahl et al. ..... D7/709
D354,292 S * 1/1995 Monti ..... D15/80
5,921,103 A * 7/1999 Hilsinger ..... 62/340
6,412,286 B1 * 7/2002 Park et al. ..... 62/3.6
6,484,529 B2 * 11/2002 Dasher et al. ..... 62/344
6,675,602 B2 * 1/2004 Goodman et al. ..... 62/324.1
6,765,031 B2 * 7/2004 Salyer et al. ..... 521/99
D499,612 S * 12/2004 Smith, Sr. ..... D7/605
7,024,880 B1 4/2006 Wagner (Continued)

OTHER PUBLICATIONS

U.S. Appl. No. 11/888,276, filed Feb. 2009, Whillock, Sr.

*Primary Examiner* — Mohammad Ali
(74) *Attorney, Agent, or Firm* — J. Wiley Horton

(57) ABSTRACT

A portable cooler including a sealable outer container, and a sealable inner container situated within the outer container. A first thermoelectric cooling device having a cooling panel and a heating panel is mounted on the wall of the outer container such that the cooling panel faces the interior of the sealable outer container and the heating panel faces outside of said sealable outer container. A second thermoelectric cooling device, also having a cooling panel and a heating panel, is mounted on the wall of the internal container such that the cooling panel faces the interior of the inner container and the heating panel faces outside of the sealable inner container into the interior of said sealable outer container.

20 Claims, 5 Drawing Sheets

U.S. PATENT DOCUMENTS 7,100,394 B2 * 9/2006 Bieberich et al. ..... 62/420
D548,249 S * 8/2007 Okamoto et al. ..... D15/84
2002/0121096 A1 * 9/2002 Harrison et al. ..... 62/3.6
2002/0124576 A1 * 9/2002 Loibl et al. ..... 62/64
2002/0194860 A1 12/2002 Goodman et al.
2006/0026985 A1 * 2/2006 Hollen et al. ..... 62/340

* cited by examiner

PORTABLE COOLER WITH INTERNAL ICE MAKER

CROSS-REFRENCES TO RELATED APPLICATIONS

This application is a continuation of U.S. application Ser. No. 11/888,276 now abandoned. Application Ser. No. 11/888.276 listed the same inventor and was filed on Jul. 31, 2007.

STATEMENT REGARDING FEDERALLY SPONSERED RESEARCH OR DEVELOPMENT

Not Applicable.

MICROFICHE APPENDIX

Not Applicable.

BACKGROUND OF THE INVENTION

1. Field of the Invention

This invention relates to the field of portable coolers. More specifically, the present invention comprises a portable cooler with an integrated internal ice maker.

2. Description of the Related Art

Portable coolers have been widely used for transporting cold storage items—such as food and drinks—from one location to another for many years. Conventionally, a portable cooler is loaded with cold storage items along with a cooling medium—such as ice or frozen gel packages—to keep the inside of the cooler cold. Assuming the cooler remains closed and a sufficient amount of cooling medium is used, the cold storage items will remain at near freezing temperatures for a couple of days. However, it is not uncommon for the contents of the container to be accessed periodically over time as the contents are consumed. This repeated opening of the container allows ambient heat to enter the portable container and expedites the depletion of the cooling medium.

More recently, electrically-powered cooling elements have been employed in portable coolers to transfer heat out of the cooler. These devices are often configured to be powered by a 12 volt DC power source, such as a cigarette lighter of an automobile. Despite the existence of such powered transportable coolers, there remains a need for a portable cooler that is able to store cold storage items and make and store ice. While these cooling elements work well for keeping the cooler at near-freezing temperatures these cooling elements are not efficient enough to freeze ice. Therefore, it would be beneficial to provide a portable cooler that is capable of making ice and is small enough to be easily transported in a vehicle.

BRIEF SUMMARY OF THE INVENTION

The present invention comprises a portable cooler including a sealable outer container, and a sealable inner container situated within the outer container. A first thermoelectric cooling device having a cooling panel and a heating panel is mounted on the wall of the outer container such that the cooling panel faces the interior of the sealable outer container and the heating panel is located on the outside of the sealable outer container. A second thermoelectric cooling device, also having a cooling panel and a heating panel, is mounted on the wall of the internal container such that the cooling panel faces the interior of the inner container and the heating panel is located outside of the sealable inner container but inside the sealable outer container.

With the thermoelectric cooling devices placed in this arrangement, the inner container can be made cold enough to freeze ice. As such, an ice maker may be placed in the inner container to provide the user with a constant supply of ice. The interior of the outer container is maintained at a temperature sufficient for the storage of drinks and food items. An integrated electrical control system is provided to distribute power to the thermoelectric cooling devices and operate the internal ice maker.

Figure 1:
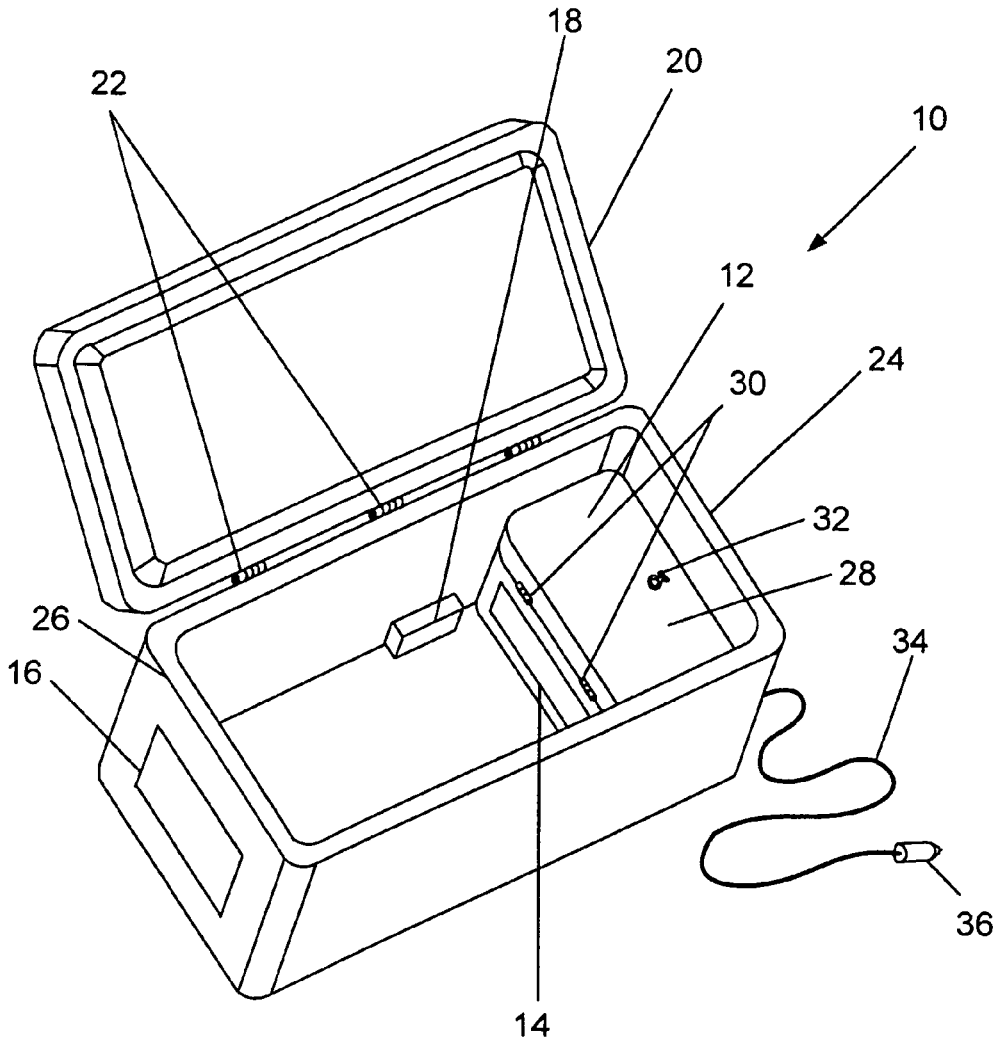
FIG. 1 is a perspective view, showing the present invention.

| REFERENCE NUMERALS IN THE DRAWINGS | |
|---|---|
| 10 | portable cooler |
| 12 | internal container |
| 14 | Peltier panel |
| 16 | Peltier panel |
| 18 | control module |
| 20 | top |
| 22 | hinges |
| 24 | insulated wall |
| 26 | insulated wall |
| 28 | top |
| 30 | hinges |
| 32 | tab |
| 34 | power cord |
| 36 | connector |
| 38 | heating plate |
| 40 | cooling plate |
| 42 | heating plate |
| 44 | cooling plate |
| 46 | ice |
| 48 | tip |
| 50 | conduit |
| 52 | pivot joint |
| 54 | motor |
| 56 | drain |
| 58 | tube |
| 60 | reservoir |
| 62 | pump |
| 64 | storage zone |
| 66 | port |
| 68 | ice maker |

DETAILED DESCRIPTION OF THE INVENTION

The present invention, portable cooler 10, is illustrated in FIG. 1. Portable cooler 10 has much in common with a conventional "ice chest" type cooler. Portable cooler 10 is shaped as a rectangular box with sealable top 20. It is preferred that portable cooler 10 be manufactured in the size range of conventional ice chest type coolers, so that portable cooler 10 may be transported in the trunk of a car.

Sealable top 20 is attached to the bottom portion of portable cooler 10 with hinges 22. Top 22 forms an air-tight seal with the bottom portion of the box when top 22 is closed. The bottom portion of portable cooler 10 is bounded by insulated walls, including insulated walls 26 and 24, and an insulated base.

Portable cooler 10 also has an integrated internal container 12 for making and storing ice. Like portable cooler 10, internal container 12 in insulated with a sealable top 28. Top 28 is attached to the insulated bottom portion of internal container 12 with hinges 30. Tab 32 is provided on top 28 to facilitate opening of top 28.

Internal container 12 and the outer container of portable cooler 10 each have a Peltier panel (Peltier panels 14 and 16, respectively) for rejecting heat out of the inside of the containers. Peltier panels 14 and 16 are thermoelectric devices which use the Peltier effect to create a temperature difference, ΔT, from an electric voltage. Commercially available Peltier panels are capable of creating a ΔT of approximately 40° F. from one side of the panel to the other. Thus, Peltier panel 16 functions to reject heat out of portable cooler 10 and thus cool the inside of portable cooler 10. Peltier panel 14 rejects heat out of internal container 12 into the inside of portable cooler 10 and cools the inside of internal container 12.

Control module 18 is provided for controlling the many electronic elements of the present invention including Peltier panels 14 and 16 and the ice maker. Power cord 34 and connector 36 are provided so that portable cooler 10 may be powered by a 12 VDC source, such as 12 VDC electrical outlet in an automobile.

Figure 2:
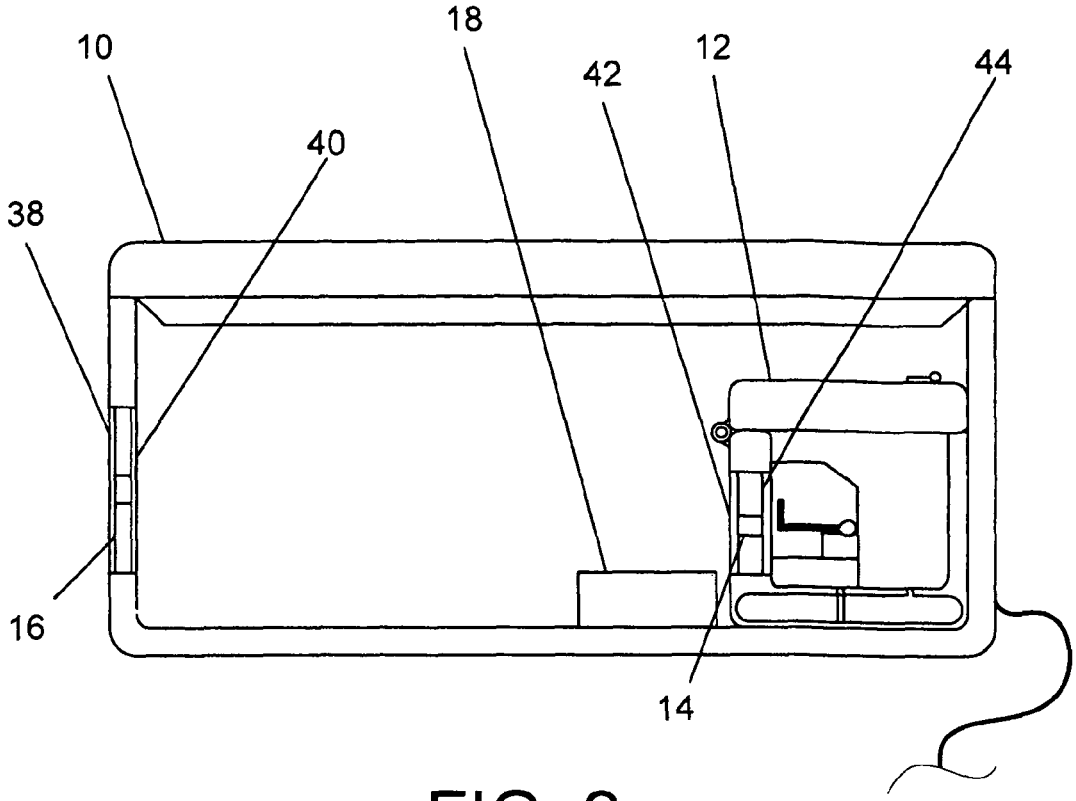
FIG. 2 is a section view, showing the present invention.

A section view is provided in FIG. 2 to illustrate the internal components of the present invention. Peltier panel 14 has cooling plate 44 facing the inside of internal container 12 and heating plate 42 facing the inside of portable cooler 10. Commercially-available Peltier panels have two ceramic plates with an array of small BismuthTelluride cubes ("couples") in between. The polarity of the DC current supplied to the panel determines the direction of heat transfer.

When powered, Peltier panel 14 transfers heat out of internal container 12 (cooling plate 44 lowers the temperature of the inside of internal container 12, and heating plate 42 heats the inside of portable cooler 10). Peltier panel 16 has cooling plate 40 facing the inside of the container and heating plate 38 facing the outside of portable cooler 10. When powered, cooling plate 40 lowers the temperature inside portable cooler 10, and heating plate 38 rejects heat outside of portable cooler 10.

It should be noted that the Peltier panels shown in the drawing views are merely representative of the type of thermoelectric devices that may be used in accordance with the present invention. Fans or other active devices may be employed with thermoelectric elements for improved efficiency. In addition, the heating and cooling plates of the Peltier panels may be ribbed or louvered to increase the surface area of heat transfer.

Although a single Peltier panel is illustrated on each container, it may be desirable to employ multiple Peltier panels on either or both internal container 12 and/or portable cooler 10. Also, Peltier panel 16 must be capable of removing the heat generated by Peltier panel 14 from portable cooler 10 while providing portable cooler 10 with a sufficiently cool internal temperature to store perishable food items and keep beverages cold.

Figure 3:
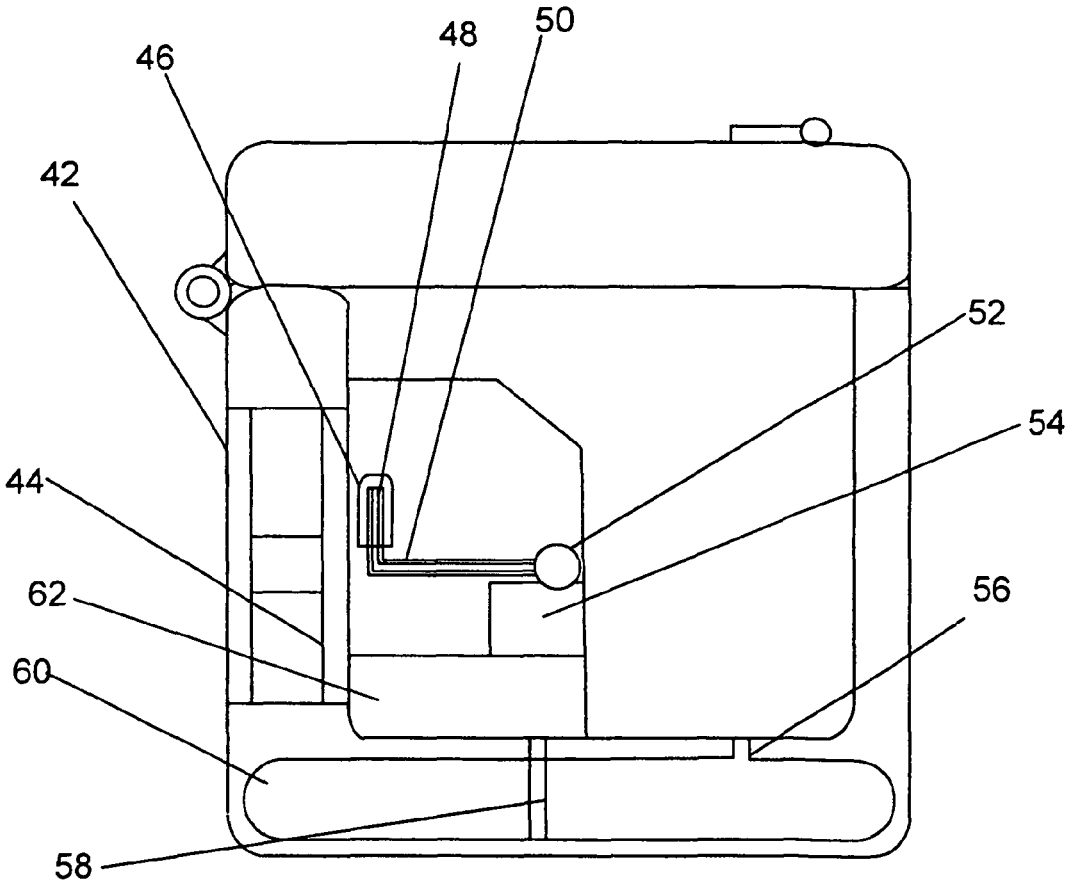
FIG. 3 is a section view, showing an internal ice maker and storage container.

A detailed illustration of the internal container is provided in FIG. 3. Reservoir 60 is provided in the bottom of the internal container to hold a supply of water for the ice maker. Tube 58 extends to the bottom of reservoir 60 and is fluidly connected with pump 62. Pump 62 draws water through tube 58 and into conduit 50. The water passes through conduit 50 out tip 48 where it begins to freeze next to cooling plate 42 as ice 46. Once ice 46 has formed on tip 48, the control module actuates motor 54 to dump ice 46.

Figure 4:
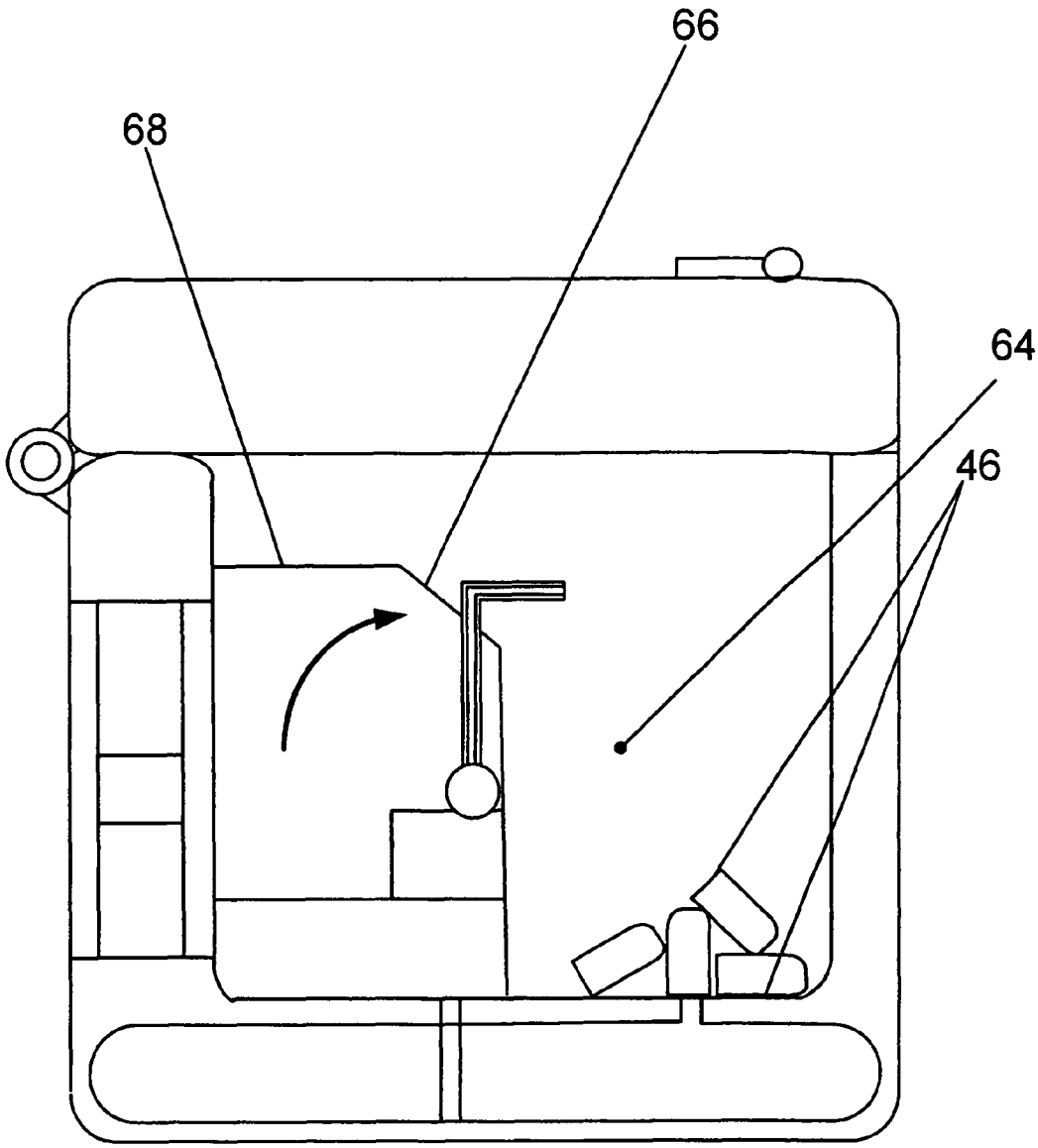
FIG. 4 is a section view, showing an internal ice maker and storage container.
Figure 5:
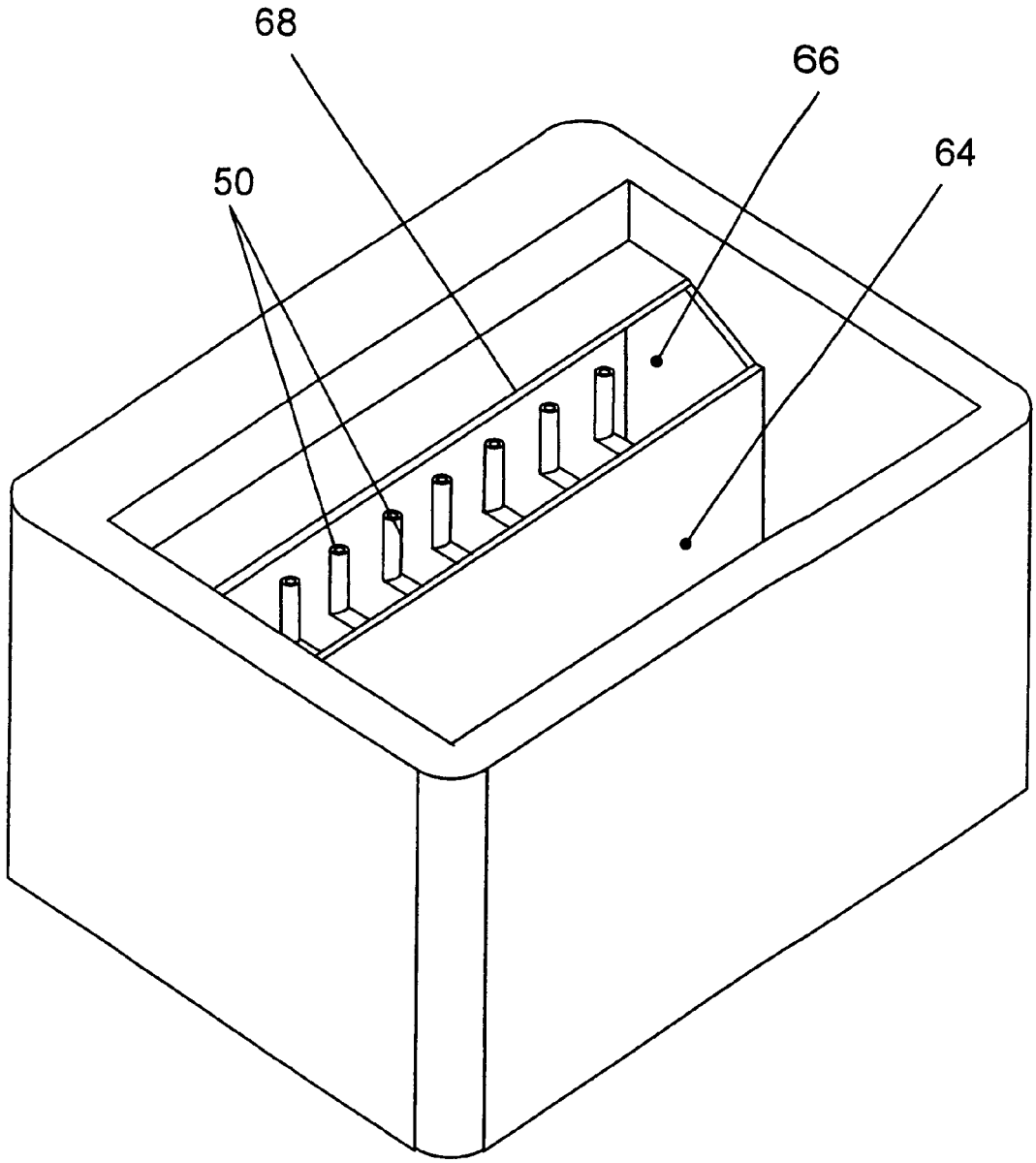
FIG. 5 is a perspective view, showing an internal ice maker and storage container.

Turning to FIG. 4, the reader will note that ice 46 is ejected through port 66 of ice maker 68 into storage zone 64. Weight sensors or timing circuits may be used to coordinate the freezing operations with the delivery of ice particles into storage zone 64. A pressure pulse of water may also be expelled by pump 62 when motor 54 causes conduit 50 to pivot about pivot joint 52. The pressure pulse of water helps separate ice 46 from tip 58 of conduit 50. Alternatively, an electric current may be supplied to conduit 50 the heat the tip of conduit 50 and loosen the ice. As shown in FIG. 5, the motor is then actuated again to return conduits 50 to their original position.

Turning back to FIG. 3, drain 56 is provided in the bottom of the storage zone, so that water melting off of the ice can return to reservoir 60. Drain 56 also provides a port for filling reservoir 60. Level sensors may be employed in reservoir 60 to shut off the ice maker when reservoir 60 is empty. The level sensors may also be integrated with a warning LED (possibly mounted on the outside of portable cooler 10) to inform the user when more water needs to be added to the reservoir.

Other features may be added to the illustrated embodiment to improve the functionality of the present invention. For example, the portable cooler can be powered with solar panels. The solar panels may be incorporated into the lid or may be a free-standing separate component that is wired to the cooler. An integrated charge controller and battery bank may be used to store the harvested solar power.

Also, top 20 may be replaced with a lid having multiple hatches, allowing the user to open a desired portion of the lid. Such a design would limit the amount of ambient heat that enters the portable cooler when the lid is opened, thereby reducing the demand on the Peltier panels.

In addition, control module 18 may include one or more switches which the user can actuate to control the polarity of the current sent to one or both Peltier panels. In the preferred embodiment, a pair of three-position switches are employed—one switch for controlling Peltier panel 14 and a second switch for controlling Peltier panel 16. These switches can be mounted to the inside or outside of the cooler. In the switch's first position, the switch sets the polarity such that the Peltier panel can be used for cooling the inside of the container. When both switches are set to this position, the cooler operates as described previously (i.e. Peltier panel 14 transfers heat out of the cooler and Peltier panel 16 transfers heat out of the internal container). In the switch's second position, the switch decouples the power from the Peltier panel so that it is inactive. The user may wish to set the switch for Peltier panel 14 to this position when the user does not require the use the ice maker. In the switch's third position, the switch reverses the polarity from the first position such that the Peltier panel can be used to heat the inside of the container. Using the third position, the user can use the "cooler" to keep food warm.

The preceding description contains significant detail regarding the novel aspects of the present invention. It should not be construed, however, as limiting the scope of the invention but rather as providing illustrations of the preferred embodiments of the invention. For example, ice maker 68 is merely representative of one type of ice maker that can be used in accordance with the present invention. Many other ice maker designs may be used. Such a variation would not alter the function of the invention. The preceding descriptions should not be construed, therefore, as limiting the scope of the invention but rather as providing illustrations of the preferred embodiments of the invention.

Having described my invention, I claim:

1. A portable cooler comprising:

a. a sealable outer container, having an insulated side wall, an insulated base, an insulated top, and an interior therebetween;

b. a sealable inner container situated within said outer container, said inner container having an interior and a wall separating said interior of said sealable inner container from said interior of said sealable outer container;

c. a first thermoelectric cooling device, having a cooling panel and a heating panel, said first thermoelectric cooling device positioned on said sealable outer container such that said cooling panel faces said interior of said sealable outer container and said heating panel faces outside of said sealable outer container;

d. a second thermoelectric cooling device, having a cooling panel and a heating panel, said second thermoelectric cooling device positioned on said sealable inner container such that said cooling panel faces said interior of said sealable inner container and said heating panel faces outside of said sealable inner container into said interior of said sealable outer container;

e. wherein said sealable outer container is transportable;

f. an ice maker located within said sealable inner container;

g. a reservoir located at the bottom of said sealable inner container;

h. said ice maker drawing water from said reservoir; and i. a drain connecting said inner container to said reservoir, so that melt water accumulating in said inner container will flow into said reservoir.

2. The portable cooler of claim 1, wherein said ice maker comprises:

a. at least one conduit having a tip; and b. said tip being located proximate said cooling panel of said second thermoelectric device, so that water flowing out of said tip will freeze and form ice on said tip.

3. The portable cooler of claim 1, said ice maker positioned adjacent to said cooling panel of said second thermoelectric cooling device.

4. The portable cooler of claim 1, said ice maker configured to dump ice pieces into an ice storage zone, said ice storage zone positioned in said interior of said sealable internal container.

5. A portable cooler comprising:

a. a first sealable container, having an insulated side wall, an insulated base, an insulated top, and an interior therebetween;

b. a second sealable container, having an insulated wall, and an interior, said second sealable container including a separating wall separating said interior of said second sealable container from said interior of said first sealable container;

c. a first thermoelectric cooling device, having a cooling panel and a heating panel, said first thermoelectric cooling device positioned on said first sealable container such that said cooling panel faces said interior of said first sealable container and said heating panel faces outside of said first sealable container;

d. a second thermoelectric cooling device, having a cooling panel and a heating panel, said second thermoelectric cooling device positioned on said second sealable container such that said cooling panel faces said interior of said second sealable container and said heating panel faces outside of said second sealable container into said interior of said first sealable container;

e. wherein said first sealable container is transportable;

f. an ice maker located within said sealable inner container;

g. a reservoir located at the bottom of said sealable inner container;

h. said ice maker drawing water from said reservoir;

i. a drain connecting said inner container to said reservoir, so that melt water accumulating in said inner container will flow into said reservoir; and j. said ice maker including a conduit having a tip configured so that water flowing out of said tip will freeze to form an ice mass thereon.

6. The portable cooler of claim 5, wherein said conduit tip is located proximate said cooling panel of said second thermoelectric device.

7. The portable cooler of claim 5, said ice maker positioned adjacent to said cooling panel of said second thermoelectric cooling device.

8. The portable cooler of claim 5, said ice maker configured to dump ice pieces into an ice storage zone, said ice storage zone positioned in said interior of said second sealable container.

9. A portable cooler comprising:

a. a first insulated sealable container having a first interior;

b. a second insulated sealable container having a second interior, said second sealable container integrated with said first sealable container such that second interior is separated from said first interior;

c. a first thermoelectric cooling device attached to said first insulated sealable container, said first thermoelectric cooling device configured to transfer heat out of said first interior by Peltier effect;

d. a second thermoelectric cooling device attached to said second insulated sealable container, said second thermoelectric cooling device configured to transfer heat out of said second interior into said first interior by Peltier effect;

e. wherein said first insulated sealable container is transportable;

f. an ice maker located within said sealable inner container;

g. a reservoir located at the bottom of said sealable inner container;

h. said ice maker drawing water from said reservoir; and i. a drain connecting said inner container to said reservoir, so that melt water accumulating in said inner container will flow into said reservoir.

10. The portable cooler of claim 9, wherein said ice maker positioned in said second sealable container includes at least one conduit having a tip, said tip being located proximate said cooling panel of said second thermoelectric device, so that water flowing out of said tip will freeze and form ice on said tip.

11. The portable cooler of claim 10, wherein said conduit has a heater configured to selectively heat said at least one conduit in order to release an ice mass formed thereon.

12. The portable cooler of claim 9, said ice maker positioned adjacent to said second thermoelectric cooling device.

13. The portable cooler of claim 10, said ice maker configured to dump ice pieces into an ice storage zone, said ice storage zone positioned in said interior of said second sealable container.

14. The portable cooler of claim 1, wherein said portable cooler is powered by a 12 VDC electrical outlet.

15. The portable cooler of claim 1, wherein said reservoir is fully contained within said portable cooler.

16. The portable cooler of claim 11, wherein said reservoir is fully contained within said portable cooler.

17. The portable cooler of claim 2, wherein said at least one conduit has a heater configured to selectively heat said at least one conduit in order to release an ice mass formed thereon.

18. The portable cooler of claim 2, wherein said at least one conduit is configured to rotate in order to release an ice mass formed thereon.

19. The portable cooler of claim 11, wherein said at least one conduit is configured to rotate in order to release an ice mass formed thereon.

20. The portable cooler of claim 12, wherein said at least one conduit is configured to rotate in order to release an ice mass formed thereon.

* * * * *